US009489904B2

(12) United States Patent
Misonou et al.

(10) Patent No.: US 9,489,904 B2
(45) Date of Patent: Nov. 8, 2016

(54) LIQUID CRYSTAL DISPLAY DEVICE

(71) Applicant: Japan Display Inc., Tokyo (JP)

(72) Inventors: Toshiki Misonou, Tokyo (JP); Tomohide Oohira, Tokyo (JP)

(73) Assignee: Japan Display Inc., Tokyo (JP)

( * ) Notice: Subject to any disclaimer, the term of this patent is extended or adjusted under 35 U.S.C. 154(b) by 234 days.

(21) Appl. No.: 14/203,843

(22) Filed: Mar. 11, 2014

(65) Prior Publication Data

US 2014/0267455 A1 Sep. 18, 2014

(30) Foreign Application Priority Data

Mar. 14, 2013 (JP) ..... 2013-051716

(51) Int. Cl.
*G09G 5/10* (2006.01)
*G09G 3/36* (2006.01)
*G09G 5/34* (2006.01)

(52) U.S. Cl.
CPC ..... *G09G 3/3614* (2013.01); *G09G 3/3648* (2013.01); *G09G 5/34* (2013.01); *G09G 2310/0213* (2013.01); *G09G 2310/0224* (2013.01); *G09G 2320/046* (2013.01)

(58) Field of Classification Search
None
See application file for complete search history.

(56) References Cited

U.S. PATENT DOCUMENTS 6,130,654 A * 10/2000 Hayashi ..... G09G 3/3659 345/215
2002/0084960 A1* 7/2002 Song ..... G09G 3/3648 345/87
2007/0195045 A1 8/2007 Kaneki

FOREIGN PATENT DOCUMENTS

JP 2007-225861 9/2007

* cited by examiner

*Primary Examiner* — William Boddie
*Assistant Examiner* — Jeffrey A Parker
(74) *Attorney, Agent, or Firm* — Typha IP LLC

(57) ABSTRACT

A liquid crystal display device includes image signal lines, a plurality of pixel circuits that is connected to the image signal lines, an image signal line driving circuit that is connected to the image signal lines, and sequentially outputs an image signal, a gate line driving circuit that supplies a scanning signal. A period in which the gate line driving circuit supplies a scanning signal to any pixel circuit is a first period in which the image signal is output to the pixel circuit when a polarity of the image signal in a previous frame is different from the polarity in the present frame, and the first period and a second period in which the image signal of a different polarity is supplied before the first period when the polarity in the previous frame is identical with the polarity in the present frame.

4 Claims, 11 Drawing Sheets

LIQUID CRYSTAL DISPLAY DEVICE

CROSS-REFERENCE TO RELATED APPLICATION

The present application claims priority from Japanese application JP2013-051716 filed on Mar. 14, 2013, the content of which is hereby incorporated by reference into this application.

BACKGROUND OF THE INVENTION

1. Field of the Invention

The present invention relates to a liquid crystal display device, and more particularly to a liquid crystal display device that inverts a polarity of an image signal to be supplied to an image signal line within a certain frame.

2. Description of the Related Art

The liquid crystal display device controls gray level of a pixel due to an electric field generated between a pixel electrode included in each pixel circuit and a counter electrode. Also, a voltage of the pixel electrode for displaying a certain gray level has two types, a voltage of a positive polarity and a voltage of a negative polarity. In this case, the voltage of the positive polarity is a voltage higher than a voltage across the counter electrode, and the voltage of the negative polarity is a voltage lower than the voltage across the counter electrode. In this case, there has been known that when a voltage of a certain polarity is applied to liquid crystal used in the liquid crystal display device for a period longer than a given period, a relationship between the voltage across the pixel electrode and the gray level is damaged (ghost image phenomenon). Therefore, a polarity of the voltage applied to the pixel electrode is reversed for each frame.

Also, there has been known that it is difficult to prevent the ghost image phenomenon by merely reversing the polarity of the voltage for each frame. For example, when vertical lines aligned every other dot in a horizontal direction are scrolled at a certain speed in a horizontal direction, an average of the voltages to be applied to a pixel electrode of a certain pixel circuit is different from a voltage across the counter electrode. As a result, the ghost image phenomenon may occur. In order to cope with this phenomenon, JP 2007-225861 A discloses that the polarity of the voltage to be applied to each pixel circuit is further inverted every time a period corresponding to a plurality of frames elapses.

SUMMARY OF THE INVENTION

In case that the polarity of the voltage to be applied to the pixel electrode is further inverted every time the period (hereinafter referred to as "long cycle inversion period") corresponding to the plurality of frames as described above elapses, the polarity of the image signal to be supplied to the pixel electrode is identical between one previous frame and the present frame every time the long cycle inversion period elapses.

In this case, when the vertical lines aligned every other dot in the horizontal direction are scrolled at the certain speed in the horizontal direction, an absolute value of a difference between the voltages to be applied to the pixel electrode, and the voltage across the counter electrode may become cyclically larger than an original value. For that reason, for example, a phenomenon such as flushing in which the gray level is cyclically emphasized is generated.

The present invention has been made in view of the above problems, and therefore an object of the present invention is to provide a liquid crystal display device which is capable of suppressing the phenomenon in which the display gray level is cyclically changed.

Typical outlines of the invention disclosed in the present application will be described below.

(1) A liquid crystal display device, including: image signal lines; a plurality of pixel circuits that is connected to the image signal lines; an image signal line driving circuit that is connected to the image signal lines, and sequentially outputs an image signal indicative of a display gray level of the plurality of pixel circuits; a plurality of gate lines that is connected to the respective pixel circuits; and a gate line driving circuit that supplies a scanning signal for storing the image signal in the pixel circuits connected to the gate lines, to the respective gate lines, in which, in case that a polarity of the image signal to be supplied to one of the plurality of pixel circuits in a previous frame is different from a polarity of the image signal to be supplied to the one pixel circuit in a present frame, the gate line driving circuit supplies the scanning signal to the one pixel circuit in a first period in which the image signal is supplied to the one pixel circuit in the present frame, and in which, in case that the polarity of the image signal to be supplied to one of the plurality of pixel circuits in the previous frame is identical with the polarity of the image signal to be supplied to the one pixel circuit in the present frame, the gate line driving circuit supplies the scanning signal to the one pixel circuit in the first period and a second period in which the image signal of a different polarity is supplied to another pixel circuit before the first period.

(2) The liquid crystal display device according to the item (1), in which the image signal line driving circuit inverts the polarity of the image signal to be output to the image signal lines in any frame every horizontal period, and in which in case that the polarity of the image signal to be supplied to one of the plurality of pixel circuits in the previous frame is identical with the polarity of the image signal to be supplied to the one pixel circuit in the present frame, the gate line driving circuit supplies the scanning signal to the one pixel circuit in the first period in which the image signal is supplied to the one pixel circuits, and the second period in which the image signal is supplied to another pixel circuit immediately before the first period.

(3) The liquid crystal display device according to the item (1) or (2), in which the image signal line driving circuit makes the polarity of the image signal to be supplied to the present frame identical with the polarity of the image signal to be supplied to the previous frame in an arbitrary pixel circuit in a frame immediately after the long cycle inversion period has elapsed, and makes the polarity of the image signal to be supplied to the present frame different from the polarity of the image signal to be supplied to the previous frame in an arbitrary pixel circuit in a frame other than the frame immediately after the long cycle inversion period has elapsed, and in which the long cycle inversion period is a cyclically repeated period which corresponds to predetermined two or more frames.

According to the present invention, the phenomenon in which the gray level displayed by any pixel is cyclically changed can be suppressed.

DETAILED DESCRIPTION OF THE INVENTION

Figure 1:
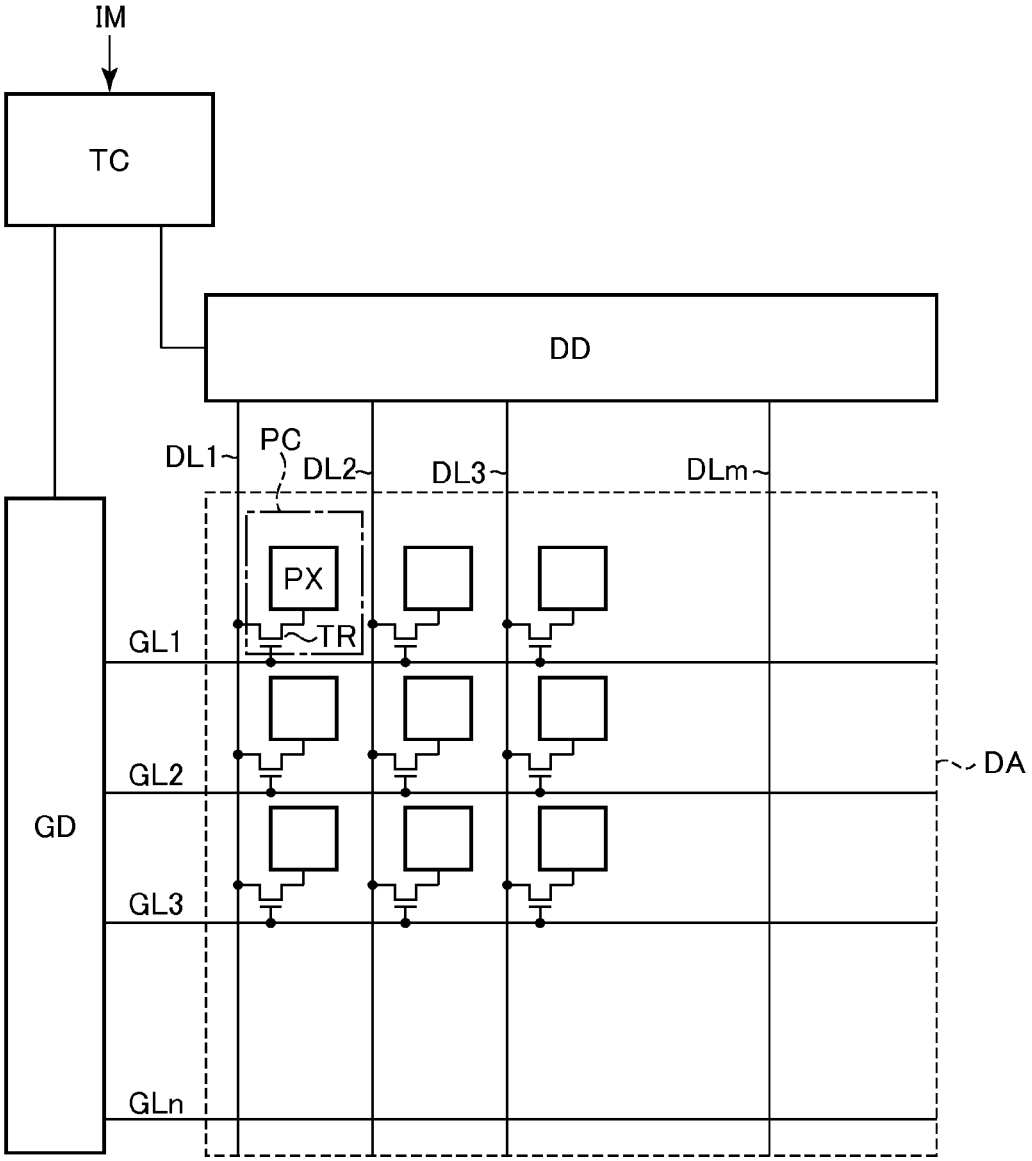
FIG. 1 is a circuit diagram illustrating an example of an equivalent circuit of a liquid crystal display device according to an embodiment of the present invention.

Hereinafter, an embodiment of the present invention will be described with reference to the accompanying drawings. Components having the same function are indicated by identical reference characters, and their description will be omitted.

A liquid crystal display device physically includes an array substrate, a counter substrate facing the array substrate; liquid crystal sealed between the array substrate and the counter substrate, and an integrated circuit and a flexible substrate which are connected to the array substrate.

FIG. 1 is a circuit diagram illustrating an example of an equivalent circuit of a liquid crystal display device according to an embodiment of the present invention. The liquid crystal display device includes a timing controller TC, an image signal line driving circuit DD, a gate line driving circuit GD, a plurality of pixel circuits PC, a plurality of image signal lines DL, and a plurality of gate lines GL. The plurality of pixel circuits PC is arranged in a display area DA of the array substrate in a matrix shape of n rows by m columns.

The image signal lines DL and the gate lines GL are formed on the array substrate. The plurality of image signal lines DL corresponds to columns of the pixel circuits PC on a one-to-one basis, and the plurality of gate lines GL corresponds to rows of the pixel circuits PC on a one-to-one basis. In this example, the image signal line DL corresponding to the pixel circuit PC in an i-column is described as DLi, and the gate line GL corresponding to the pixel circuit PC in a j-row is described as GLj.

Each of the pixel circuits PC includes a pixel switch TR and a pixel electrode PX. A counter electrode (not shown in the figure) is present on the display area DA, and a given voltage (hereinafter called "common voltage Vc") is applied to the counter electrode. Liquid crystal is present between the pixel electrode PX and the counter electrode to configure a pixel capacitance. The pixel switch TR is a thin film transistor, and includes a gate electrode, a source electrode, and a drain electrode. The gate electrode is connected to the corresponding gate line GL, the source electrode is connected to the pixel electrode PX, and the drain electrode is connected to the corresponding image signal line DL. The thin film transistor has no polarity, and the source electrode and the drain electrode are generally conveniently called according to an applied voltage. The connection destinations of the source electrode and the drain electrode may be opposite to those shown.

The timing controller TC decodes an image data IM input from an external, and outputs gray level data indicative of gray level displayed by each of the pixel circuits PC, and timing signals. The timing signals are signals indicative of timing at which the scanning signal is supplied to the gate lines GL, and timing at which the image signal is supplied to the image signal lines DL, and include a horizontal synchronization signal, a vertical synchronization signal, and clock.

The image signal line driving circuit DD is connected with one ends of the plurality of image signal lines DL. The image signal line driving circuit DD outputs the image signals toward the respective pixel circuits PC through the image signal lines DL on the basis of the gray level data and the timing signals which are input from the timing controller TC. The image signal line driving circuit DD repetitively outputs the image signals in order from a first-row pixel circuit PC every one horizontal period 1H (corresponding to the horizontal synchronization signal). When the image signal line driving circuit DD outputs the image signal toward the pixel circuit PC on an n-th row, the image signal line driving circuit DD stops outputting the image signal in a given period. With this operation, one frame FRM is displayed. Also, the image signal line driving circuit DD repetitively outputs the image signals to the respective pixel circuits PC in the above method to display the subsequent frames FRM.

The gate line driving circuit GD is connected with one ends of the gate lines GL. The gate line driving circuit GD supplies the scanning signal to the gate line GL corresponding to the row of the appropriate pixel circuit PC at timing when the image signal line driving circuit DD outputs the image signal on the basis of the gray level data and the timing signals which are input from the timing controller TC. When the scanning signal is supplied to the gate line GL, the pixel switch TR included in the pixel circuit PC of the row corresponding to that gate line GL turns on. Then, the image signal supplied to the image signal line DL is supplied to the pixel electrode PX of the pixel circuit PC on that row.

Subsequently, the polarity of the image signal supplied by the image signal line driving circuit DD will be described. In this example, the polarity is determined according to whether a voltage of the image signal is higher than a common voltage Vc, or not, and that the voltage of the image signal is higher than the common voltage Vc is called "positive polarity", and that the voltage of the image signal is lower than the common voltage Vc is called "negative polarity". In the following description, it is assumed that the common voltage Vc is 0.

Figure 2:
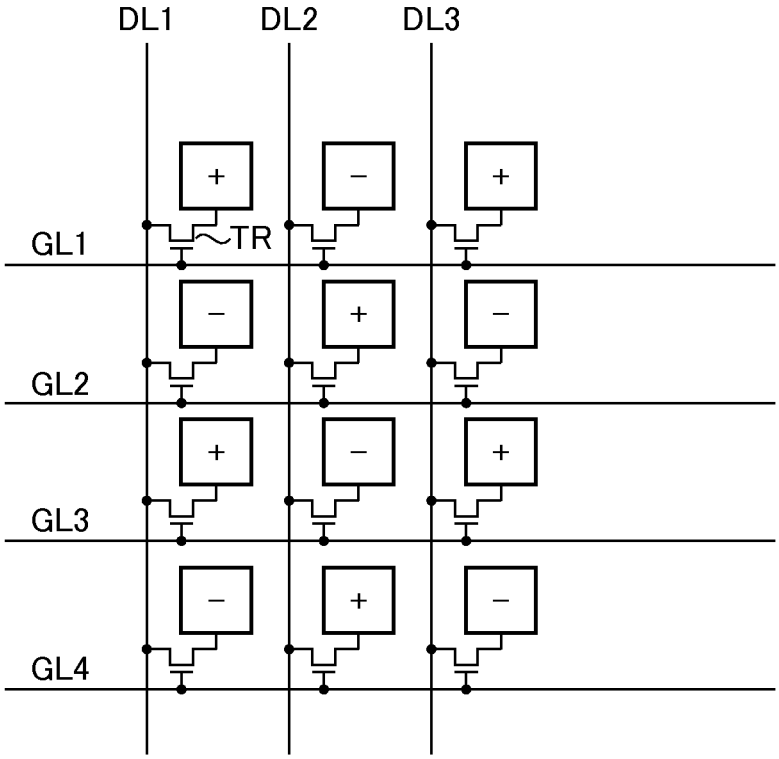
FIG. 2 is a diagram illustrating an example of a polarity of an image signal to be supplied to each pixel circuit in a certain frame.

FIG. 2 is a diagram illustrating the polarity of the image signal to be supplied to each pixel circuit PC in the certain frame FRM. A pixel capacitance included in each of the pixel circuits PC stores a potential difference based on the image signal supplied to the pixel electrode PX, and displays the gray level based on the potential difference. In the following description, the image signal having a voltage indicative of the gray level expressed by a certain pixel circuit PC is called "image signal to be supplied to the pixel circuit PC". The image signals to be supplied to the pixel circuits PC each having the pixel electrode PX with a symbol of "+" in FIG. 2 are signals of the positive polarity, and the image signals to be supplied to the pixel circuits PC each having the pixel electrode PX with a symbol of "−" in FIG. 2 are signals of the negative polarity.

For example, the image signal to be supplied to the pixel circuit PC on a first row and a first column by the image signal line driving circuit DD has the positive polarity, and the pixel capacitance of the pixel circuit PC stores the potential difference based on the voltage of the image signal. Thus, the image signal line driving circuit DD supplies the image signal of the negative polarity to the pixel circuits PC which are disposed on the left, right, top, and bottom of a pixel circuit PC to which the image signal of the positive polarity is supplied. Also, the image signal line driving circuit DD supplies the image signal of the positive polarity to the pixel circuits PC which are disposed on the left, right, top, and bottom of a pixel circuit PC to which the image signal of the negative polarity is supplied. In this example, a pattern for supplying the image signal to the respective pixel circuits PC as illustrated in FIG. 2 is called "polarity pattern A".

Also, when attention is paid to the column of the pixel circuits PC connected to the image signal lines DL, the polarity of the image signals supplied to the pixel circuits PC is inverted with proceeding in the rows. Therefore, in the example of FIG. 2, the polarity of the image signal is inverted every one horizontal period 1H (every time the pixel circuit PC to which the image signal is supplied is switched to another). This is called "line inversion". Also, that the polarity of a certain pixel circuit PC is opposite to the polarity of the right and left pixel circuits PC is "dot inversion".

Figure 3:
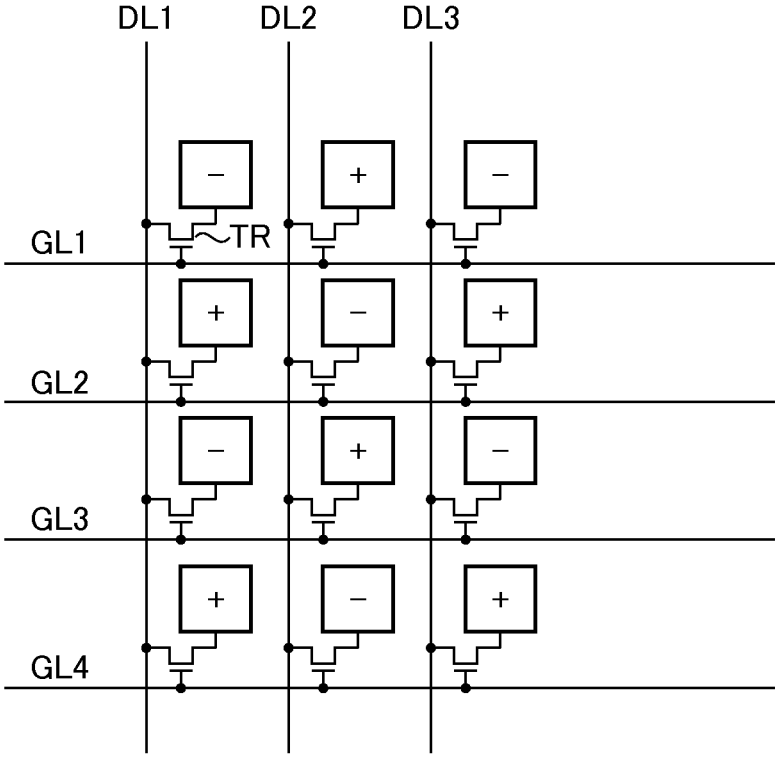
FIG. 3 is a diagram illustrating an example of the polarity of the image signal to be supplied to each pixel circuit in another frame.

FIG. 3 is a diagram illustrating the polarity of the image signal to be supplied to each pixel circuit PC in another frame FRM. The polarity of the image signal to be supplied to the respective pixel circuits PC is inverted between FIGS. 3 and 2. A pattern for supplying the image signal to the respective pixel circuits PC as illustrated in FIG. 3 is called "polarity pattern B" hereinafter. The pattern of the polarity when supplying the image signal to the pixel circuits PC within the display area DA has two types, the polarity pattern A and the polarity pattern B. In the liquid crystal display device according to this embodiment, a method (hereinafter referred to as "gate line driving method") in which the gate line driving circuit GD drives the gate lines GL is switched to another according to an appearance manner of this pattern so as to prevent a change in the cyclic gray level.

Figure 4:
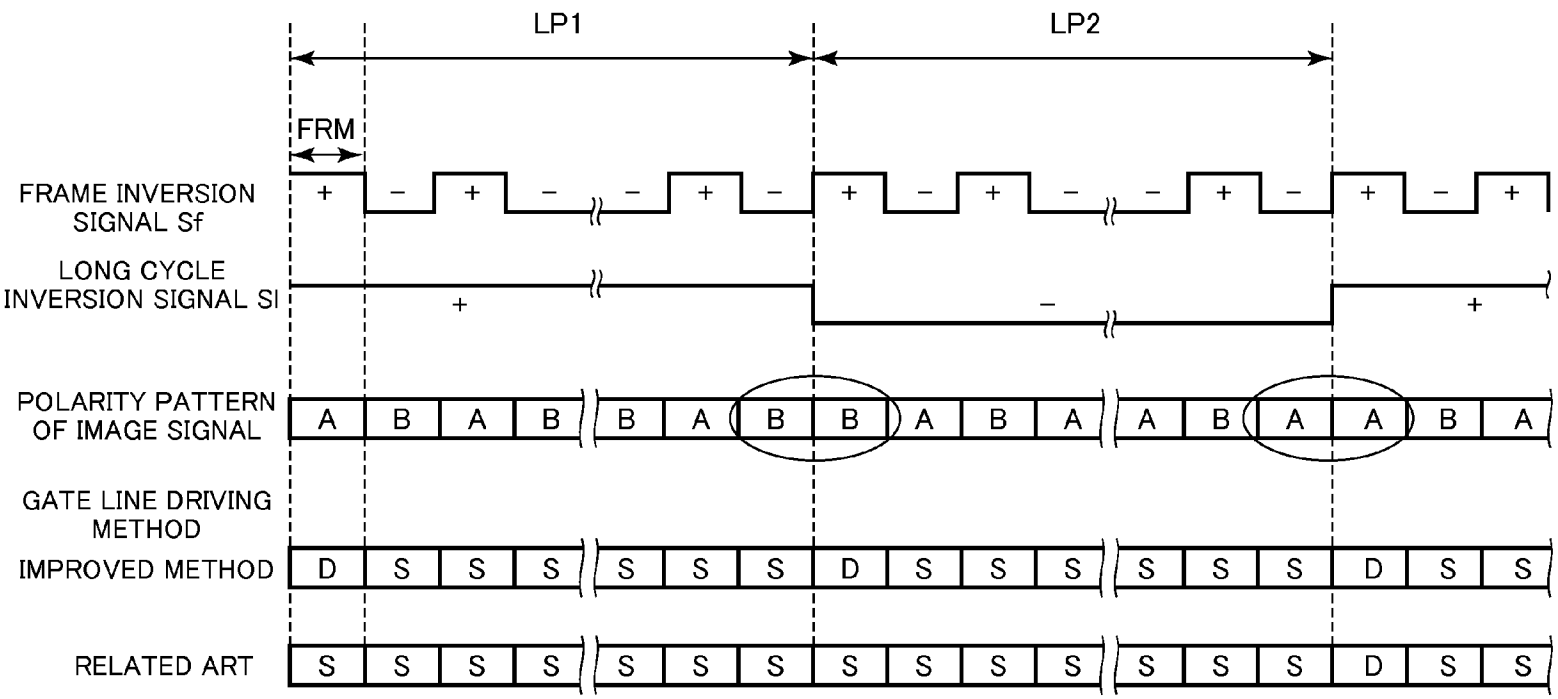
FIG. 4 is a diagram illustrating an example of a relationship between a polarity pattern of the image signal and a gate line driving method.

FIG. 4 is a diagram illustrating an example of a relationship between the polarity pattern of the image signal and the gate line driving method. FIG. 4 illustrates how the polarity pattern and the gate line driving method are changed every time the frame FRM to be displayed is changed. A period for displaying one frame FRM is called "frame period". In the related art gate line driving method ("related art" in FIG. 4), all of the gate lines GL are driven in the single gate pulse method S. On the other hand, in this embodiment ("improved method" in FIG. 4), driving method including the double gate pulse method is conducted as described later.

In this example, the polarity pattern indicated by the image signal output by the image signal line driving circuit DD is determined on the basis of an exclusive OR of a frame inversion signal Sf and a long cycle inversion signal S1. The frame inversion signal Sf is a signal inverted every time the frame FRM to be output proceeds to next, and the long cycle inversion signal S1 is a signal inverted every time long cycle inversion periods LP1 and LP2 corresponding to, for example, 60 frames elapse. Here, the inversion of the frame inversion signal Sf and the long cycle inversion signal S1 means that the voltage is switched between a voltage (+) of a high level and a voltage (−) of a low level. For example, if both voltages of the frame inversion signal Sf and the long cycle inversion signal S1 are high level or low level, the image signal line driving circuit DD outputs the image signal indicative of the polarity pattern A. If one voltage of the frame inversion signal Sf and the long cycle inversion signal S1 is high level, and the other voltage is low level, the image signal line driving circuit DD outputs the image signal indicative of the polarity pattern B.

Then, in the long cycle inversion period LP2, the polarity pattern of the frame FRM immediately after the long cycle inversion period LP2 starts becomes identical with the polarity pattern of the previous frame FRM. Also, the polarity pattern of frames FRM after the frame FRM immediately after the long cycle inversion period LP2 starts is different from the polarity pattern of the previous frame FRM. The same is applied to the other long cycle inversion period.

Also, the gate line drive method includes a single gate pulse method S and a double gate pulse method D. If the polarity pattern of the previous frame FRM and the polarity pattern of the present frame FRM are different from each other, the gate line driving circuit GD drives the gate lines GL by the single gate pulse method S. In this case, the polarity of the image signal indicative of the gray level displayed by a certain pixel circuit PC is changed between the previous frame FRM and the present frame FRM. On the other hand, if the polarity pattern of the previous frame FRM and the polarity pattern of the present frame FRM are identical with each other, the gate line driving circuit GD drives the gate lines GL by the double gate pulse method D. In this case, the polarity of the image signal indicative of the gray level displayed by a certain pixel circuit PC is identical between the previous frame FRM and the present frame FRM.

Figure 5:
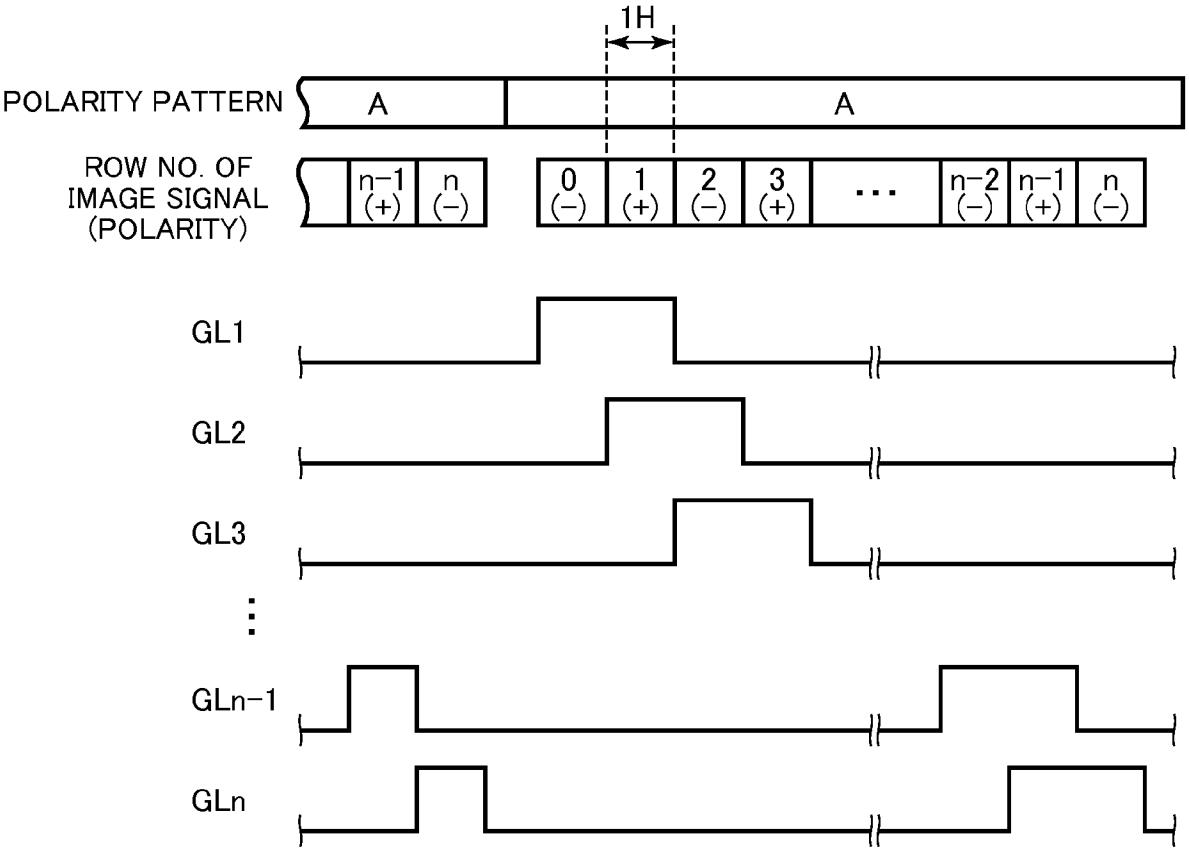
FIG. 5 is a diagram illustrating an example of the scanning signal to be supplied to the gate line in a double gate pulse method.

FIG. 5 is a diagram illustrating an example of the scanning signal to be supplied to the gate line GL in the double gate pulse method D. FIG. 5 illustrates transitions of the polarity pattern, the image signal to be supplied to a certain image signal line DL, and the scanning signals to be supplied to the gate lines GL1 to GLn with time. In FIG. 5, a period in which one polarity pattern A is continued corresponds to one frame FRM.

In the double gate pulse method D, to a gate line GL corresponding to a certain row of the pixel circuit PC, the gate line driving circuit GD supplies the scanning signal (specifically, voltage of the high level) in a horizontal period 1H in which the image signal to that row is supplied from the image signal line driving circuit DD, and in the previous horizontal period 1H. The image signal line driving circuit DD supplies a dummy image signal (corresponding to row No. 0 in FIG. 5) to the pixel circuit PC on the first row in one horizontal period 1H immediately before the image signal is supplied to the pixel circuit PC on the first row. The dummy image signal has polarity different from the image signal to the pixel circuit PC on the first row.

Figure 6:
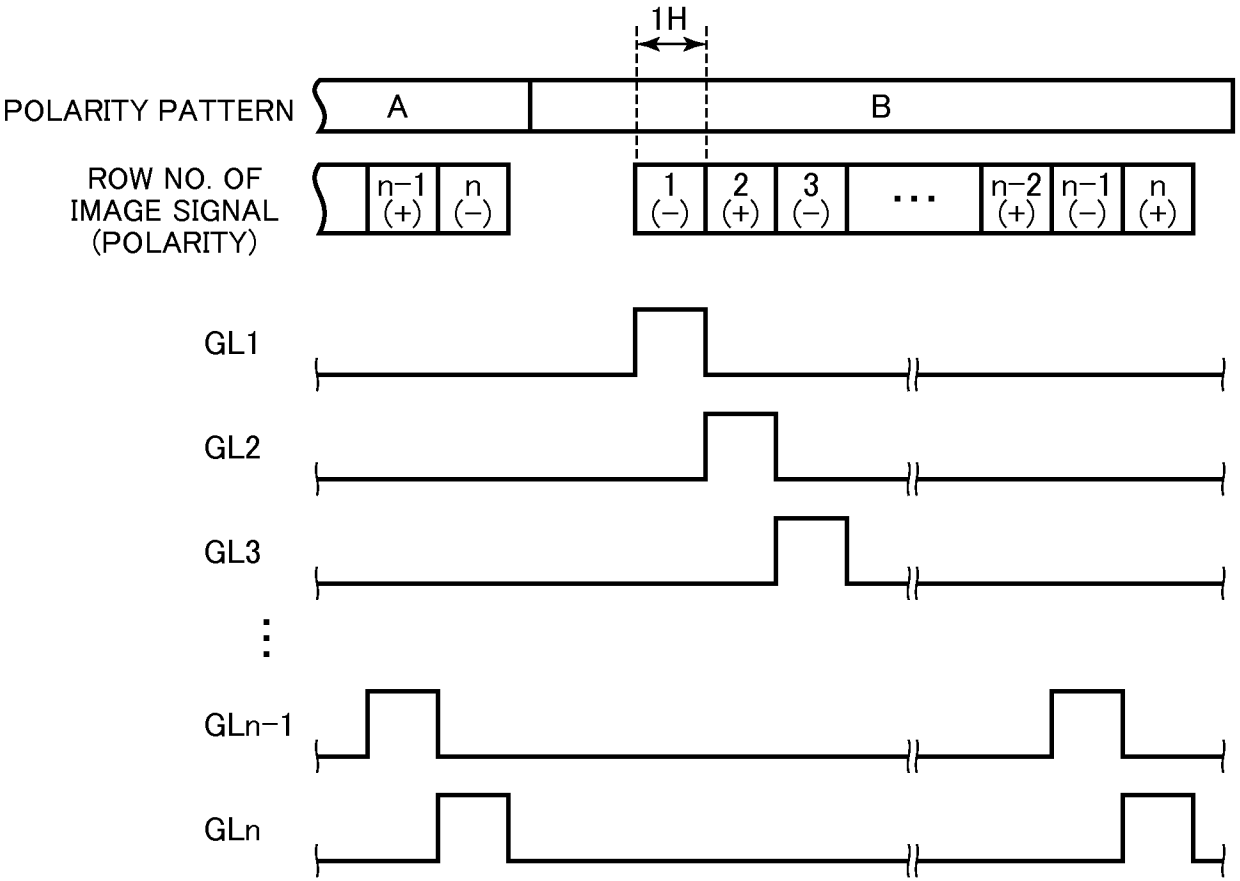
FIG. 6 is a diagram illustrating an example of a scanning signal to be supplied to gate lines in a single gate pulse method.

FIG. 6 is a diagram illustrating an example of the scanning signal to be supplied to gate lines in the single gate pulse method S. FIG. 6 illustrates the transitions of the polarity pattern, the image signal to be supplied to a certain image signal line DL, and the scanning signals to be supplied to the gate lines GL1 to GLn with time. In FIG. 6, a period in which one polarity pattern B is continued corresponds to one frame FRM.

In the single gate pulse method S, to the gate line GL corresponding to a certain row of the pixel circuits PC, the gate line driving circuit GD supplies the voltage of high level of the scanning signal in only the horizontal period 1H in which the image signal to that row is supplied from the image signal line driving circuit DD.

In the double gate pulse method D, in a period in which the scanning signal is supplied to the pixel circuit PC on a certain row, a period in which the image signal indicative of the gray level of the pixel circuit PC on a row different from that row may not be the previous horizontal period 1H. If the polarity of the image signal is opposite to the polarity of the image signal on that row, the period may be, for example, a horizontal period 1H in which the image signal is output to a row which is three rows before the certain row.

Figure 7:
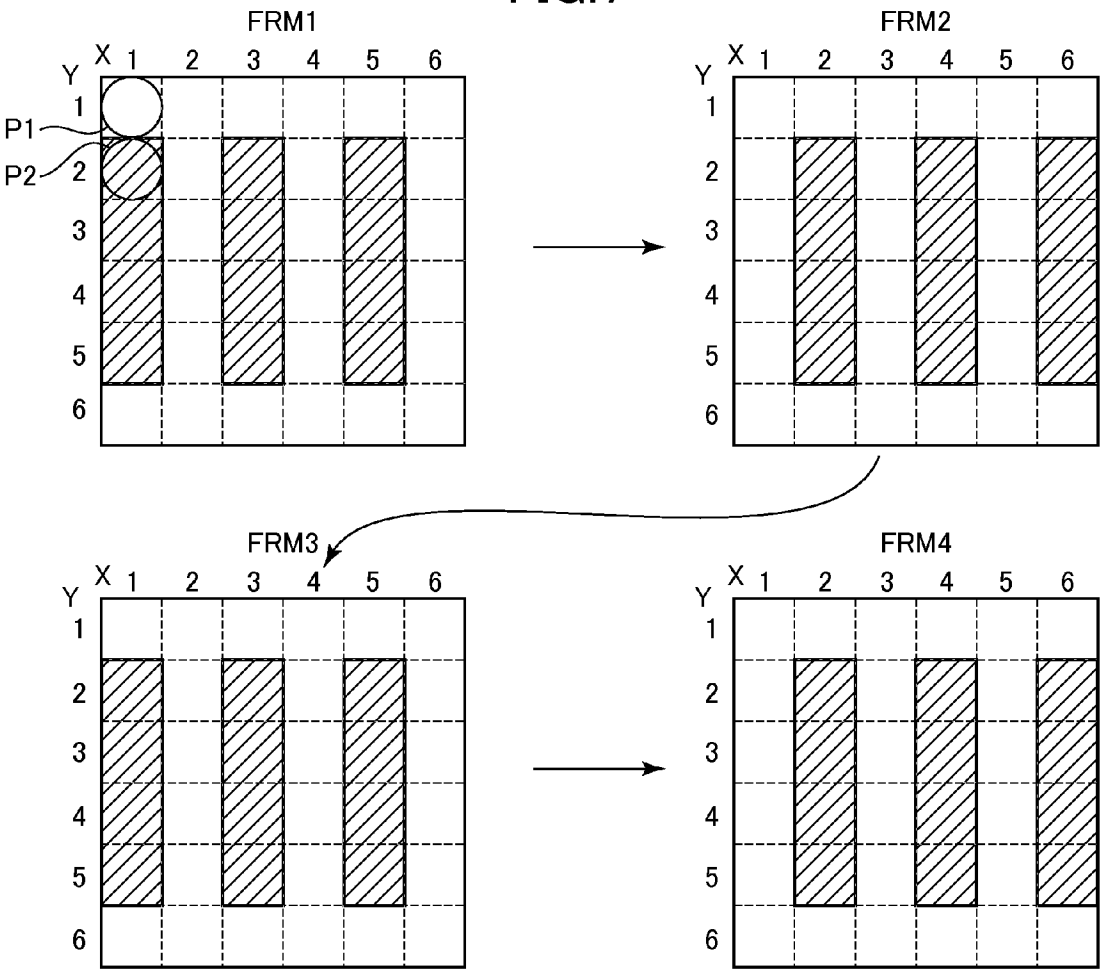
FIG. 7 is a diagram illustrating an example of a change of a test display pattern with time.

Subsequently, the advantages obtained by the above-mentioned driving method of the gate lines GL will be described. FIG. 7 is a diagram illustrating an example of a change of a test display pattern with time. In this display pattern, in a frame FRM1 first displayed, line segments of 4×1 dots are aligned every one dot in a horizontal direction. As the frame FRM1 is advanced to a frame FRM2, a frame FRM3, and a frame FRM4 for display in the stated order, those line segments are scrolled every one dot in the horizontal direction in the display pattern. In this display pattern, a burn-in phenomenon is generated unless the long cycle inversion signal S1 is used. Also, if the single gate pulse method S is always used, flushing which will be described later is generated. Brightness at a point P1 is always maximum, and brightness at a point P2 is changed from maximum to minimum, or from minimum to maximum every time the frame FRM is proceeding.

Figure 8:
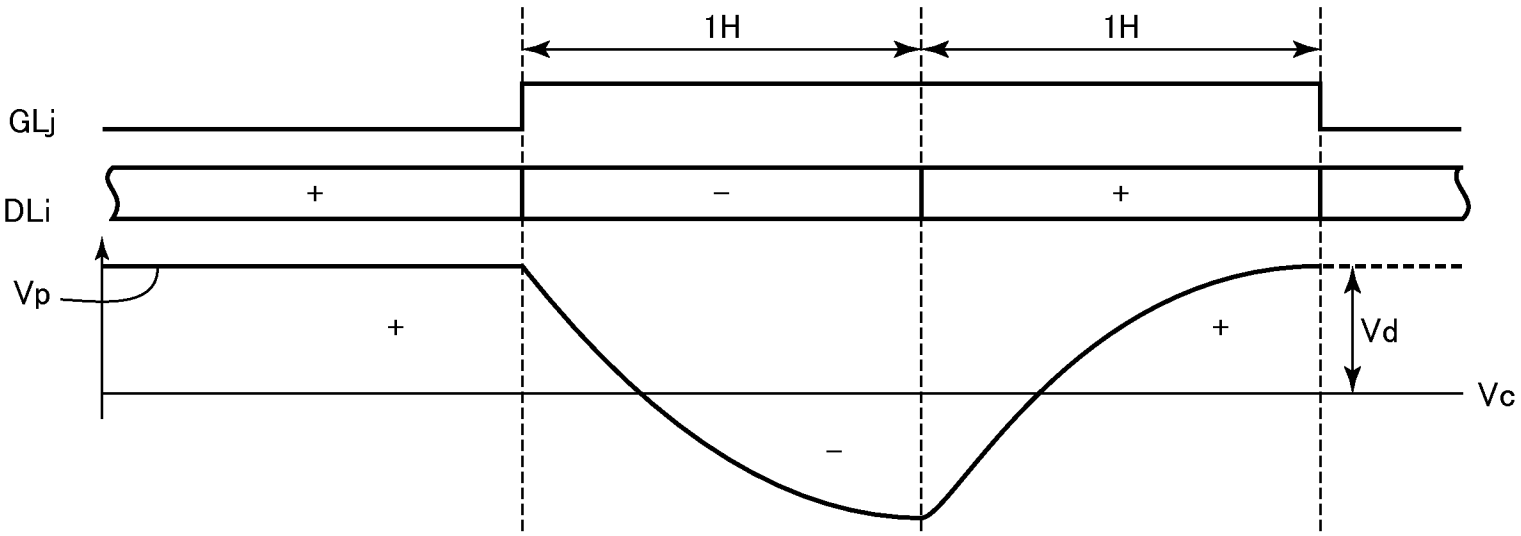
FIG. 8 is a diagram illustrating an example of a change of a voltage across a pixel electrode with time when the double gate pulse method is used.

FIG. 8 is a diagram illustrating an example of a change of a voltage Vp across the pixel electrode PX with time when the double gate pulse method D is used. The pixel electrode PX is included in a j row i column pixel circuit PC, and more specifically, the pixel electrode PX is an example of the pixel circuit PC corresponding to the point P1. When the double gate pulse method D is used, the polarity pattern is identical between the previous frame FRM and the present frame FRM. Therefore, in the drawing, the polarity of the voltage Vp before the gate line driving circuit GD supplies the scanning signal is identical with the polarity of the image signal output by the image signal line driving circuit DD in this frame FRM.

In the example of FIG. 8, the scanning signal is supplied in the horizontal period 1H immediately before the image signal line driving circuit DD supplies the image signal to the pixel circuit PC, an image signal line DLi and a pixel electrode PX are electrically connected to each other, electric charge of the image signal is charged in a capacitance between the pixel electrode PX and the counter electrode. When the horizontal period 1H is finished, the polarity of the voltage Vp is identical with the polarity of the image signal. However, because the charging operation is not completely conducted, an absolute value of the voltage Vp is smaller than the image signal. Then, the polarity of the image signal to be supplied to the subsequent horizontal period 1H is further inverted, and the electric charge of the image signal is again charged in the capacitance. As a result, at timing when the supply of the scanning signal and the image signal is finished, the polarity of the voltage Vp (called "display voltage Vd" since this voltage determines the display gray level in the pixel circuit PC) across the pixel electrode PX is identical with the image signal indicative of the gray level of the pixel circuit PC, but the absolute value of the display voltage Vd is smaller than the image signal.

Figure 9:
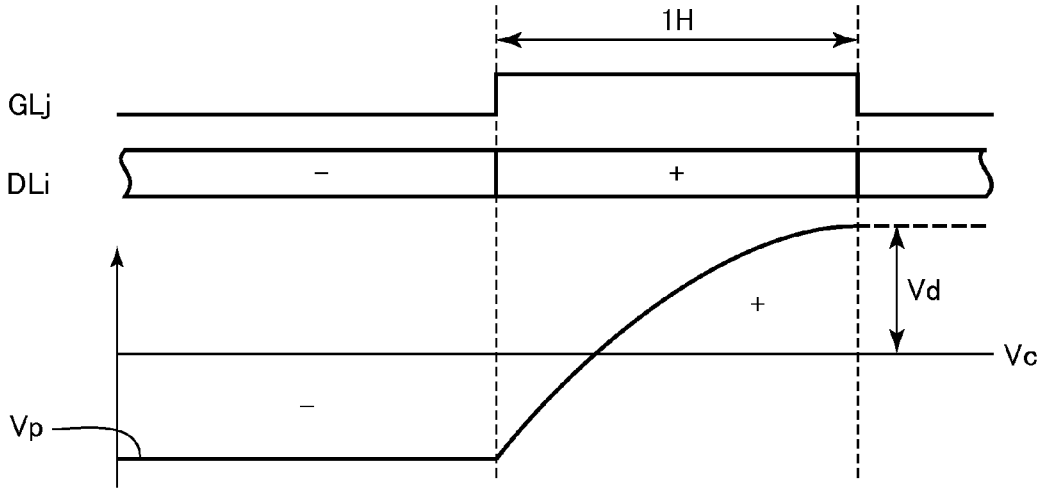
FIG. 9 is a diagram illustrating an example of a change of the voltage across the pixel electrode with time when the single gate pulse method is used.

FIG. 9 is a diagram illustrating an example of the change in the voltage Vp of the pixel electrode PX with time in case that the single gate pulse method S is used. This is also an example of the point P1. When the single gate pulse method S is used, the polarity pattern is different between the previous frame FRM and the present frame FRM. Therefore, in this drawing, the polarity of the voltage Vp before the gate line driving circuit GD supplies the scanning signal is different from the polarity of the image signal output by the image signal line driving circuit DD in this frame FRM.

In the example of FIG. 9, the scanning signal is supplied in the horizontal period 1H in which the image signal line driving circuit DD supplies the image signal to the pixel circuit PC, and electric charge of the image signal is charged in the capacitance between the pixel electrode PX and the counter electrode. Then, the polarity of the display voltage Vd at timing in which the horizontal period 1H is finished is identical with the polarity of the image signal, but the absolute value of the voltage Vp is smaller than the image signal.

As described above, in a period in which the scanning signal is supplied to the pixel circuit PC with the double gate pulse method D, the polarity of the voltage Vp of the pixel electrode PX in a horizontal period 1H corresponding to an anterior half of the period is changed to a polarity opposite to that of the image signal input after that horizontal period 1H. As a result, even if the polarity pattern is not changed from the previous frame FRM, a state of the pixel circuit PC is substantially identical with that when the polarity pattern is changed. With this situation, flushing can be suppressed more than a case where this method is not used.

Figure 10:
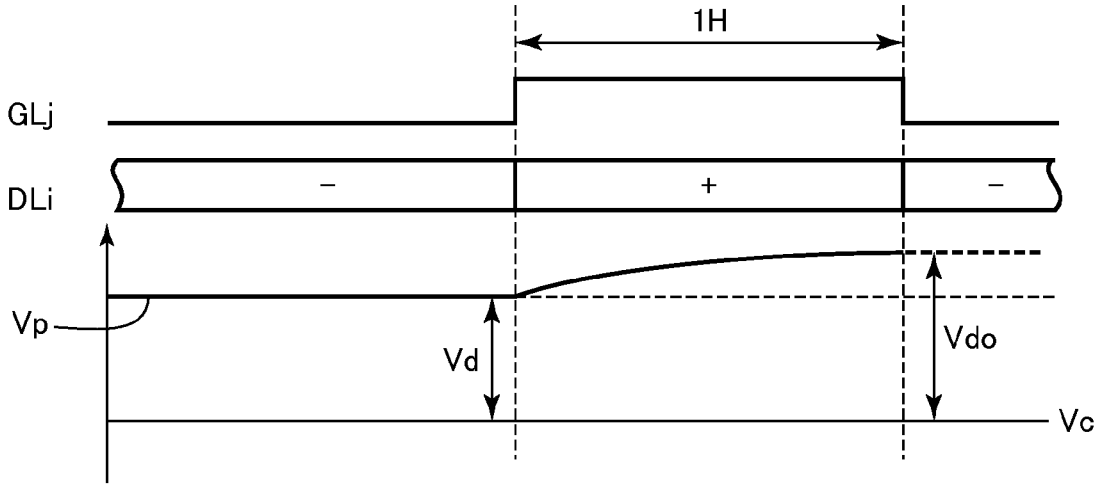
FIG. 10 is a diagram illustrating a comparative example of a change of the voltage across the pixel electrode with time.

On the other hand, in case that the single gate pulse method S is used although the polarity pattern is not changed, a display voltage Vdo of the pixel electrode PX is different from that in case that the polarity pattern is changed. FIG. 10 is a diagram illustrating a comparative example of the change of the display voltage Vp of the pixel electrode PX with time. This is an example in which the single gate pulse method S is used although the polarity pattern is not changed. In this case, the voltage of the pixel electrode PX at timing when the supply of the image signal starts is identical in polarity with the image signal, and a potential difference therebetween is small. For that reason, a voltage Vdo of the pixel electrode PX in an end of the horizontal period 1H is closer to that of the image signal than that in the cases illustrated in FIGS. 8 and 9. Then, a difference is generated in display voltage between this frame FRM and another frame FRM, and the display gray level output by the pixel circuit PC is cyclically changed.

Figure 11:
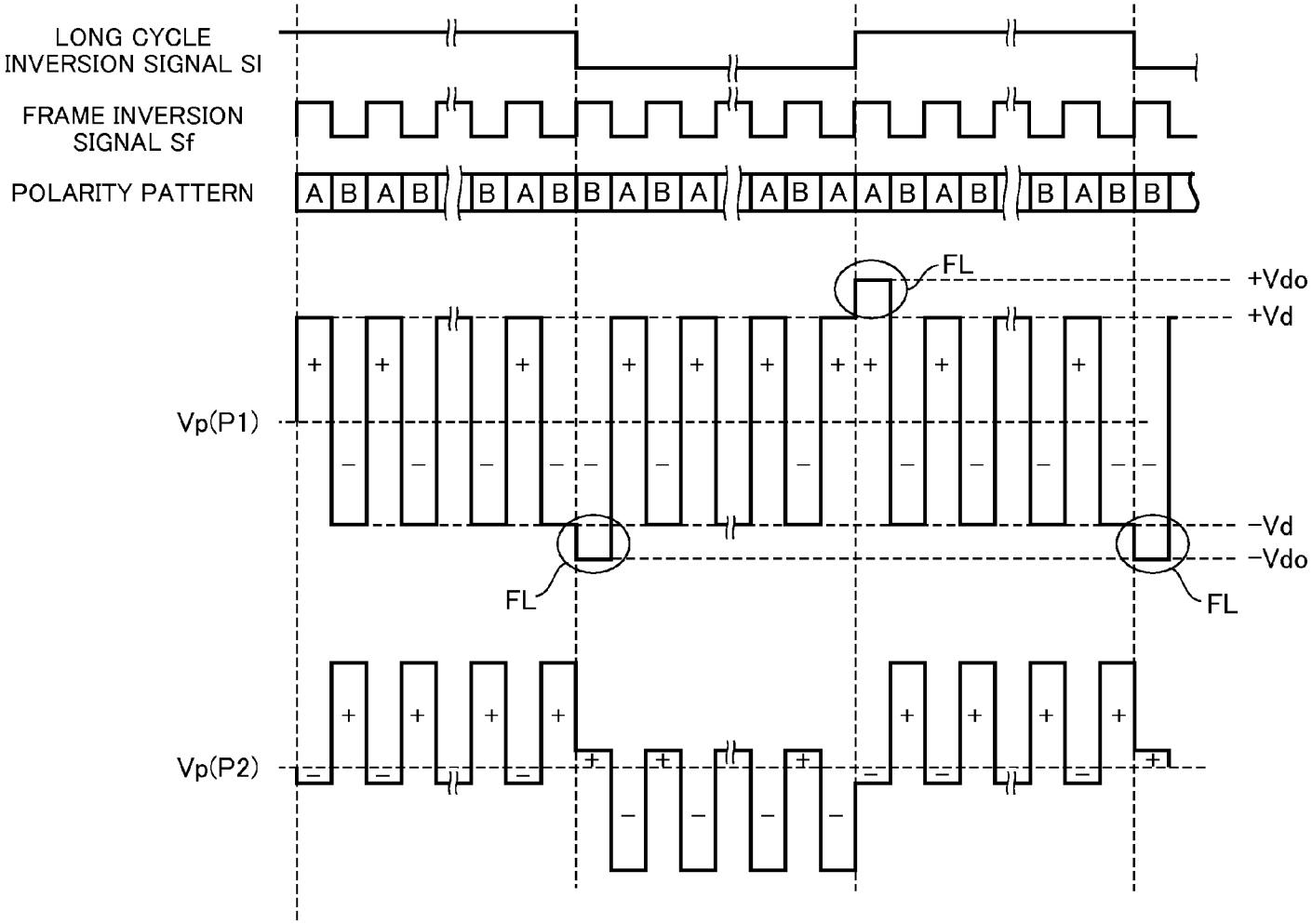
FIG. 11 is a diagram illustrating an example of a flushing generated in the comparative example illustrated in FIG. 10.

FIG. 11 is a diagram illustrating an example of a flushing generated in the comparative example illustrated in FIG. 10. In case that the driving method of the gate line GL is not changed regardless of whether the polarity pattern is changed or not, an absolute value of the voltage Vp(P1) at the point P1 is not Vd but Vdo in the frame FRM immediately after the long cycle inversion signal S1 has been switched to another. As a result, in the case of liquid crystal which is normally black, the gray level in this frame FRM is brighter than that of the other frames FRM, and flushing FL is generated. In the case of liquid crystal which is normally white, the gray level in this frame FRM is darker than that of the other frames FRM, and flushing FL is generated.

The present invention can be also applied to the liquid crystal display device of an IPS system, or the liquid crystal display device of a TN system or a VA system. This is because those liquid crystal display device are common in that components corresponding to the pixel electrode PX and the counter electrode are present.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A liquid crystal display device, comprising: image signal lines;

a plurality of pixel circuits that is connected to the image signal lines; an image signal line driving circuit that is connected to the image signal lines, and sequentially outputs an image signal indicative of a display gray level of the plurality of pixel circuits;

a plurality of gate lines that is connected to the respective pixel circuits; and a gate line driving circuit that supplies a scanning signal for storing the image signal in the pixel circuits connected to the gate lines, to the respective gate lines, wherein a frame inversion signal indicating a polarity of the image signal of each frame is input to the image signal line driving circuit, wherein a long cycle inversion signal indicating a polarity of the image signal of several sequential frames is input to the image signal line driving circuit, wherein the image signal line driving circuit outputs a first polarity pattern to the plurality of pixel circuits when both of a voltage of the frame inversion signal and a voltage of the long cycle inversion signal are one of high-level and low-level, wherein the image signal line driving circuit outputs a second polarity pattern to the plurality of pixel circuits when one of a voltage of the frame inversion signal and a voltage of the long cycle inversion signal is high-level and other thereof is low-level, wherein the second polarity pattern is different from the first polarity pattern.

2. The liquid crystal display device according to claim 1, wherein the image signal line driving circuit inverts the polarity of the image signal to be output to the image signal lines in any frame every horizontal period.

3. The liquid crystal display device according to claim 1, wherein a long cycle inversion period is a cyclically repeated period which corresponds to two or more predetermined frames.

4. The liquid crystal display device according to claim 1, wherein the second polarity pattern has an inverted polarity pattern of the first polarity pattern.

* * * * *